United States Patent [19]

Badillo et al.

[11] Patent Number: 4,961,572

[45] Date of Patent: Oct. 9, 1990

[54] GRIP GUIDE FOR TENNIS RACQUET

[76] Inventors: Paul Badillo, 4380 Perry St., Denver, Colo. 80212; Ronald M. Kronenberger, 731 S. Plymouth Ct., Chicago, Ill. 60605

[21] Appl. No.: 374,949

[22] Filed: Jul. 3, 1989

Related U.S. Application Data

[63] Continuation of Ser. No. 122,175, Nov. 18, 1987, abandoned, which is a continuation of Ser. No. 760,270, Jul. 29, 1985, abandoned.

[51] Int. Cl.[5] ..... A63B 49/00

[52] U.S. Cl. ..... 273/75; D21/222

[58] Field of Search ..... 273/73, 75, 165, 166, 273/81 D, 81.4; D21/221, 222

[56] References Cited

U.S. PATENT DOCUMENTS

| | | | |
|---|---|---|---|
| 3,614,100 | 10/1971 | Spitz | 273/75 |
| 3,817,521 | 6/1971 | Wright | 273/75 |

FOREIGN PATENT DOCUMENTS

| | | | |
|---|---|---|---|
| 2928995 | 4/1981 | Fed. Rep. of Germany | 273/75 |
| 1389488 | 4/1975 | United Kingdom | 273/75 |

*Primary Examiner*—William H. Grieb

*Attorney, Agent, or Firm*—Clement and Ryan

[57] ABSTRACT

A grip guide for a tennis racquet handle that positions the player's hand in the proper position on the racquet handle, primarily for hitting Eastern backhand shots but also for various other shots if desired. The device extends, when secured to the racquet handle, across the left bevel of the handle and at least a part of the top surface of the handle. It has a nonplanar bottom shaped to provide a reliable, non-skid gripping contact with at least two planar surfaces of the racquet handle. It has a side wall cross section in the approximate shape of a rounded "V" with its open end facing away from the free end of the racquet handle, one arm of the rounded "V" extending circumferentially along the left bevel of the handle a substantial distance away from the other arm in a direction generally opposite the direction in which the other arm extends. The arm of the rounded "V" that extends along the top surface of the racquet handle is preferably the longer arm. In a preferred embodiment, the grip guide has the form of an elongated shell, with the bottom of the "V" shaped side wall positioned adjacent the left bevel of the racquet handle. It is preferred that the grip guide have a bottom wall formed of a firm, resilient material.

10 Claims, 4 Drawing Sheets

FIG. 1
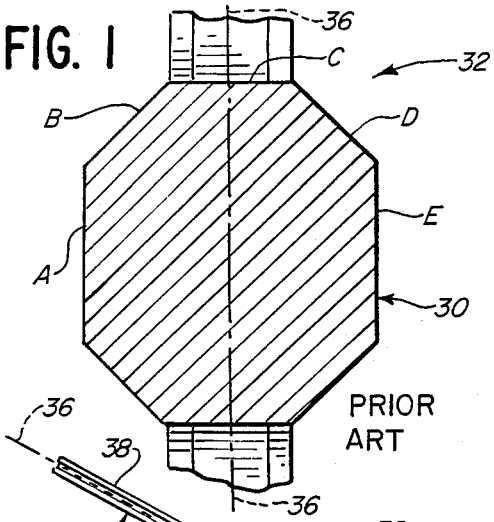
PRIOR ART
FIG. 2
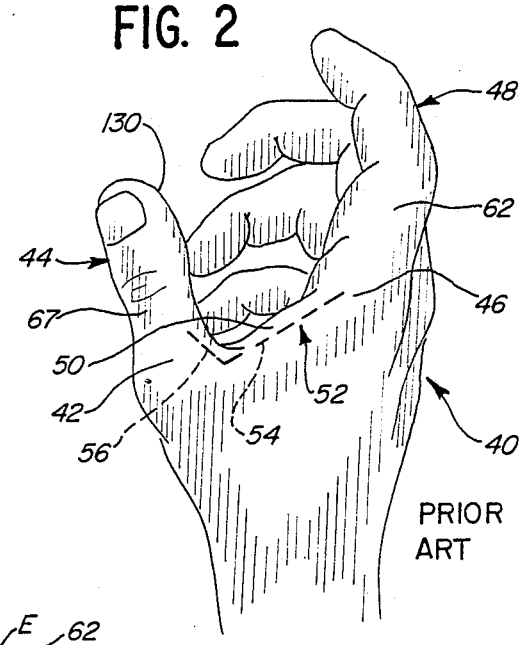
PRIOR ART
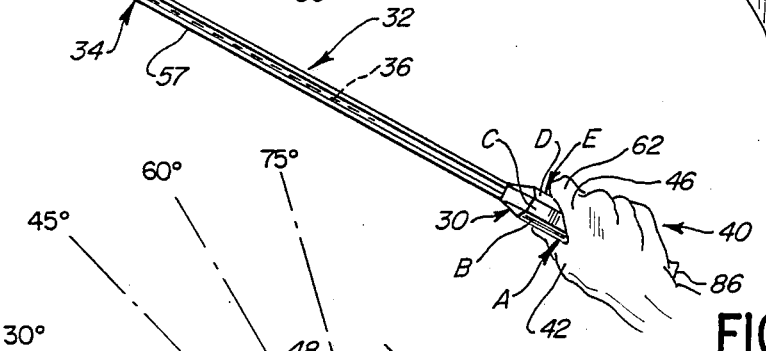
FIG. 3 PRIOR ART
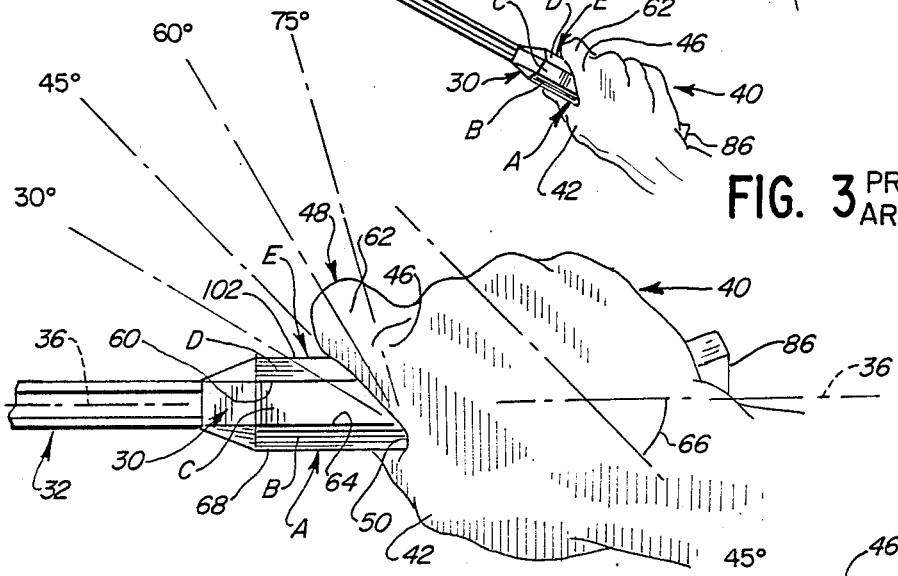
FIG. 4 PRIOR ART
FIG. 5
PRIOR ART
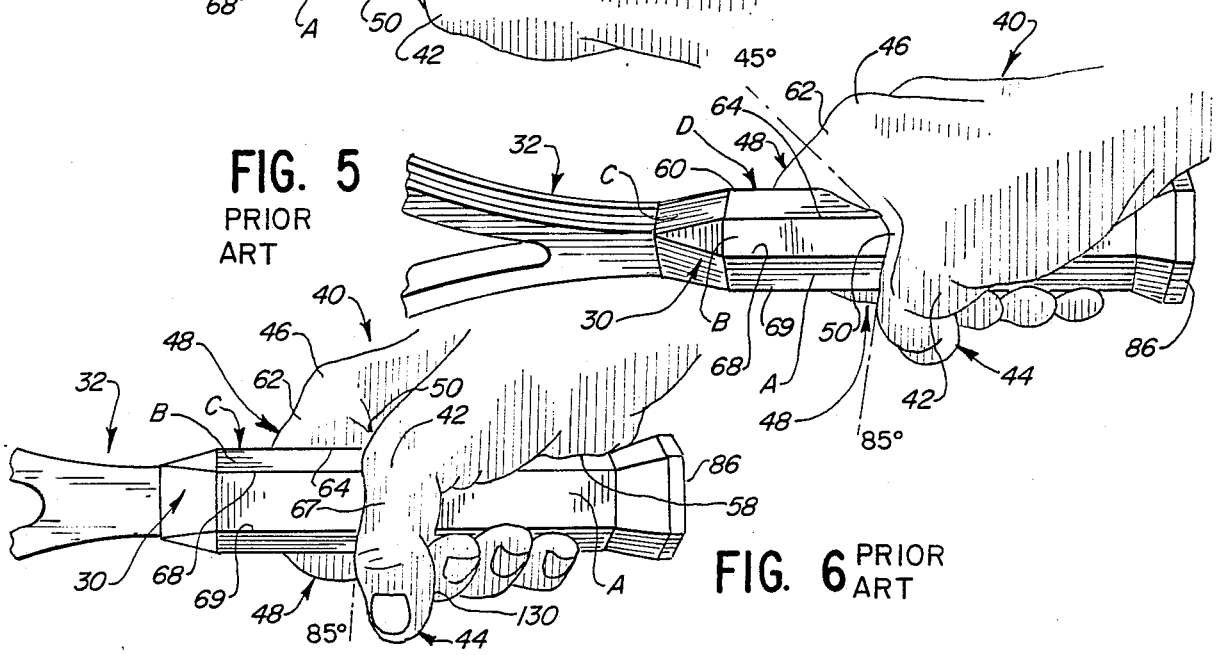
FIG. 6 PRIOR ART FIG. 7
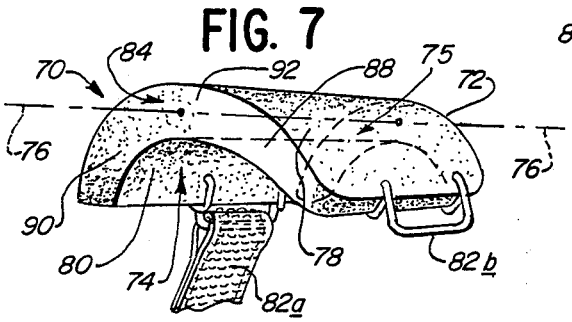
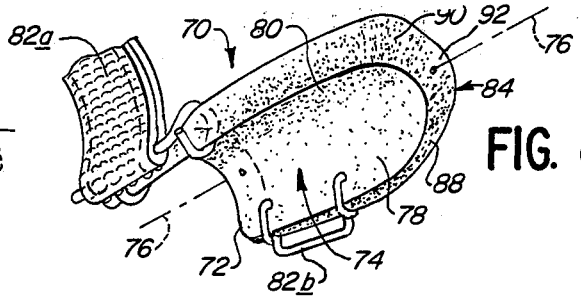
FIG. 8
FIG. 9
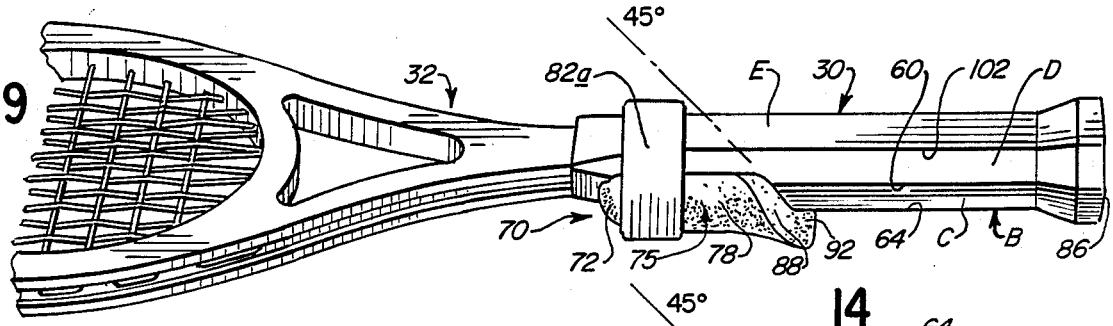
FIG. 10
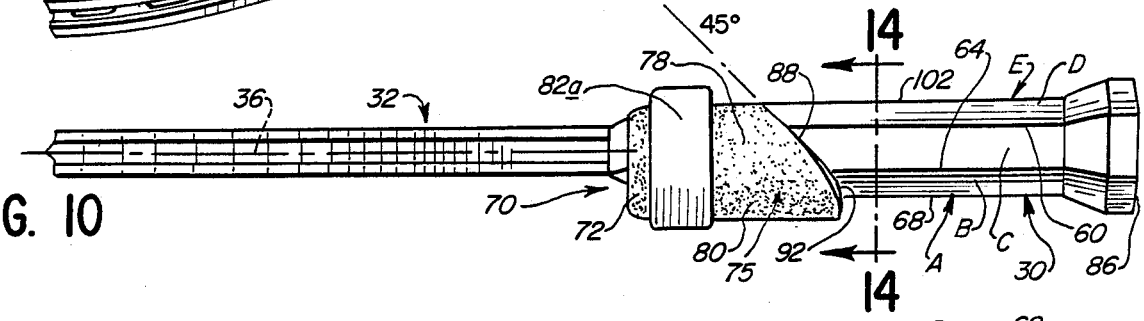
FIG. 11
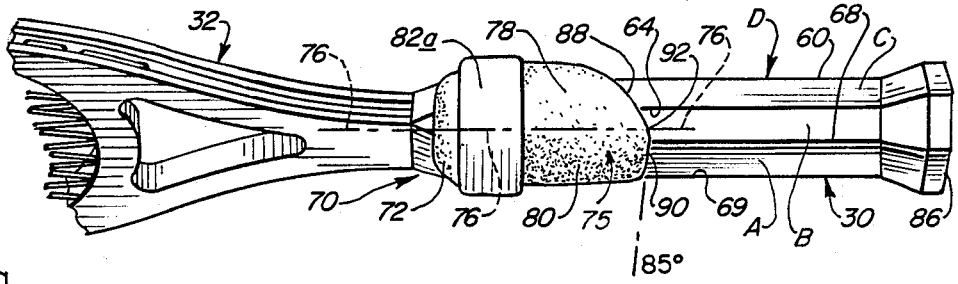
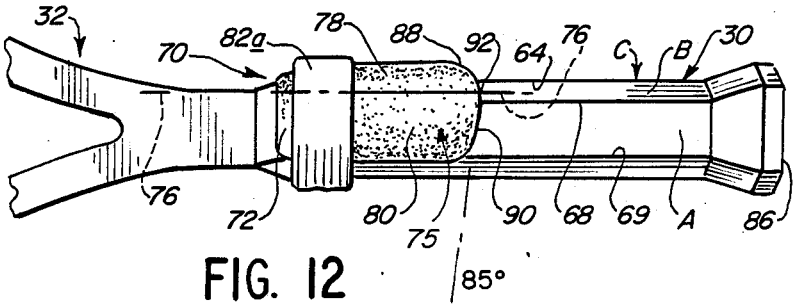
FIG. 12
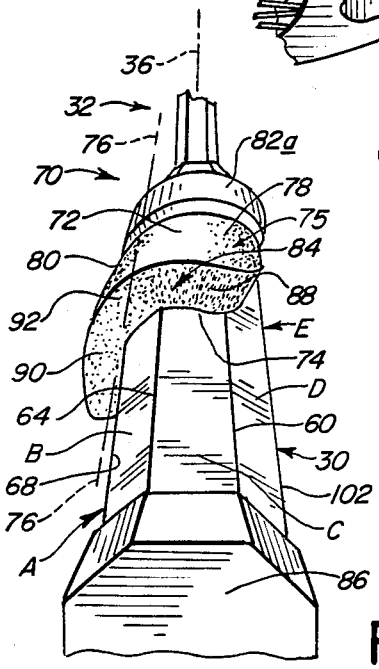
FIG. 13

GRIP GUIDE FOR TENNIS RACQUET

This application is a continuation co-pending application Ser. No. 122,175 filed by the same inventors on Nov. 18, 1987, which was a continuation of their co-pending application Ser. No. 760,270 filed by the same inventors on July 29, 1985, both now abandoned.

This invention relates to a device for guiding a tennis player to place his or her hand in the proper position on the racquet handle, primarily for hitting Eastern backhand shots but also for various other shots if desired.

BACKGROUND OF THE INVENTION

Many tennis coaches and teaching professionals characterize the Eastern backhand stroke as "the most natural stroke" in the game of tennis. This is a difficult proposition to sell to most players of average ability, or even to many players of above average ability, in view of their experience of finding the backhand stroke to be one of the hardest in the game for them to feel comfortable with.

The forehand stroke is ordinarily the first ground stroke that a tennis beginner learns, and most players continue to feel more comfortable with that stroke than with the backhand stroke even after years of experience. One of the basic continuing problems for many players in attempting to master the fundamentals of the backhand stroke is for the player to learn to place the racquet holding hand upon the racquet handle in the proper manner to position the racquet head in the desired plane with respect to the court surface as the ball is struck and carried forward during the rest of the stroke. Once a proper grip is assured, whether from good playing habits or by a device such as the grip guide of this invention, the successful execution of the backhand stroke comes much more easily.

The earliest patent known to applicants that discloses a grip for a tennis racquet handle is U.S. Pat. No. 412,479 issued to Davis in 1889. The grip in this patent is positioned underneath the user's hand. This was the principal expedient utilized for racquet handle grips for almost a century, including the grips covered by such patents as Berzatzy U.S. Pat. No. 3,203,697 issued in 1965, Jones U.S. Pat. No. 3,868,110 issued in 1975, Ballog U.S. Pat. No. 3,905,598 issued in 1975 British Pat. No. 1,389,488 issued in 1975, Cope U.S. Pat. No. Des. 240,367 issued in 1976, Soldavini U.S. Pat. No. 4,006,896 issued in 1977, Sweet U.S. Pat. No. Des. 245,443, also issued in 1977, and German application 2928995 laid open in 1981.

This concentration on grips underlying the hand for tennis racquets was paralleled by a similar focus on such grips for golf clubs. Examples of such patents are Connell U.S. Pat. No. 1,855,126 issued in 1932, Link U.S. Pat. No. 2,088,008 issued in 1937, Wheeler et al. U.S. Pat. No. Des. 125,602 issued in 1941, Strazza U.S. Pat. No. Des. 156,578 issued in 1949, Strickler U.S. Pat. No. 2,765,174 issued in 1956, Turner U.S. Pat. No. 2,877,018 issued in 1959, Lowden U.S. Pat. No. 2,962,288 issued in 1960, British patent No. 3,111,322 issued in 1963, Rosasco U.S. Pat. No. 3,706,453 issued in 1972, and Takeshima U.S. Pat. No. 4,116,440 issued in 1978.

Other approaches to the design of special grips for golf clubs are exemplified by two patents disclosing guides overlying the hand, Mohr U.S. Pat. No. 1,843,039 issued in 1932 and Hara U.S. Pat. No. 2,645,484 issued in 1953, and by a group of patents disclosing guides providing notches for the tips of the player's thumbs and index fingers, Holden et al. U.S. Pat. No. 1,997,364 issued in 1935, Yeager U.S. Pat. No. 2,223,437 issued in 1940, Strazza U.S. Pat. No. 2,484,762 issued in 1949, Schimansky U.S. Pat. No. 2,710,190 issued in 1955, Jacques U.S. Pat. No. 3,806,130 issued in 1974, Prisco U.S. Pat. No. 3,860,243 issued in 1975, and Kokes U.S. Pat. No. 4,361,326 issued in 1982.

Wright U.S. Pat. No. 3,817,521, issued in 1974, followed this latter approach for a grip guide for tennis racquets.

Despite all the inventive activity in the search for grips and grip guides for tennis racquets and golf clubs that will assist a player in maintaining the proper grip upon the handle of the racquet or the shaft of the club, only one prior patent is known to applicants that involves the concept of guiding the user's hand or hands from somewhere other than underneath the hand, overlying the hand, or at the tips of the fingers or thumbs of the hands. And in that patent, Bertucci U.S. Pat. No. 4,072,311 issued in 1978, the purpose of the invention (to spread the index finger and the next adjacent finger of a tennis player's racquet hand during forehand shots) is entirely different from applicants' purpose, and is accomplished through a structure wholly different from applicants' unique structure.

SUMMARY OF THE INVENTION

The grip guide of this invention includes stop means for contact with the V-shaped gap between the base knuckle of the thumb and the base knuckle of the index finger of the player's racquet holding hand, to guide the hand automatically into the proper position for the Eastern backhand grip—and for various other grips if desired—when the player's hand abuts the stop means. The device is used with a tennis racquet having a standard handle formed of a plurality of planar surfaces. It leaves the entire area of those planar surfaces, insofar as they are in contact with the palm, fingers and thumb of the player's racquet holding hand, free of any obstruction, including any topographical departure from the planar surfaces that make up the conventional tennis racquet handle, whenever a one-handed grip is employed and, with some embodiments, even if a two-handed backhand grip is employed.

As a result of this construction, the player can quickly and automatically position his or her hand upon the racquet handle with a conventional Eastern backhand grip (and certain other grips if desired) simply by the feel of the guide against the player's hand, without looking at the handle or the position of the hand on the handle. The player can also, when desired, place his or her hand on the racquet handle in the proper position for an Eastern forehand shot without any obstruction on the surface of the handle to rotation of the hand from the backhand position to the proper forehand position (When the term "obstruction on the surface of the racquet handle" is used in this specification and claims, it includes any impediment, hindrance, or obstacle on that surface beneath any part of the player's hand is he or she grips the handle for any given type of shot.

The grip guide of this invention indicates the proper longitudinal and circumferential positions, in order for the user of the racquet to make given types of shots most effectively, of the portion of the player's racquet holding hand that defines the above mentioned V-shaped gap between the thumb and index finger of the player's hand. This is accomplished by providing a guide surface at the end of the grip guide that is closest to the free end of the racquet handle, which guide surface has the approximate shape of a rounded "V" with its open end facing away from the free end of the handle. The rounded "V" is preferably unequal sided, with the arm of the "V" that provides a guide surface for the base knuckle of the index finger and for the index finger itself preferably the longer arm.

The racquet with which this grip guide is used has a flat ball striking head and a handle extending therefrom. The conventional handle of such a racquet is defined by a plurality of elongated, rectangular planar surfaces. These surfaces include among others, when the handle is held in the horizontal position with the racquet face perpendicular to the ground, (1) a rear planar surface that is parallel to the median plane of the flat racquet and is located on the side of the racquet that is opposite the racquet face that contacts the ball in a backhand shot, (2) a top planar surface perpendicular to said racquet head median plane, (3) a first beveled planar surface connecting the rear planar surface and the top planar surface of the handle, (4) a second beveled planar surface adjoining the top planar surface on the opposite side thereof from the first beveled surface, and (5) a front planar surface that is parallel to said median plane of the flat racquet and is located on the same side as the racquet face that contacts the ball in a backhand shot. (As will be seen, the description just given of these five planar surfaces is applicable whether the racquet is held by a left-handed or a right-handed player.)

The grip guide of this invention includes stop means adapted to be secured to the handle of the racquet, and means for securing that stop means to the handle. The stop means is arranged so that, when secured to the racquet handle, it is adjacent both the first beveled planar surface of the handle and the top planar surface of the handle. The stop means has a nonplanar bottom or concave undersurface, which is shaped to provide a reliable, non-skid, gripping contact with at least two planar surfaces of the racquet handle.

When the stop means is secured to the racquet handle as just described adjacent the top planar surface and first beveled planar surface of the handle, it provides the above mentioned guide surface to abut the player's racquet holding hand. The bottom of the described rounded "V" shape of this guide surface is preferably positioned adjacent the first beveled planar surface of the racquet handle, either immediately next to that planar surface or adjacent one of the edges of that surface along.

If the "V" bottom is positioned anywhere along the first beveled surface or adjacent the edge of that beveled surface that borders the rear planar surface (according to the individual player or coach), the grip guide indicates the proper position for the conventional Eastern backhand grip. If it is positioned adjacent the other edge of the first beveled surface, which borders the top planar surface, the proper position for the conventional Continental grip is indicated.

(The term "adjacent" is used in this specification and in the claims to mean "at or near"; if a reference line is involved, the term "adjacent" includes positions on either side of that line.)

Both arms of the guide surface shape of a rounded "V" slant away from the free end of the racquet handle as one moves outward in opposite circumferential directions around the handle. With an unequal sided "V," the shorter arm preferably extends toward the rear planar surface of the racquet handle, and the longer arm preferably extends towards the second beveled planar surface of the handle.

When the grip guide of this invention is secured to the racquet handle as described, the entire surface of the racquet handle is left free of any obstruction insofar as any areas of that surface are concerned to which the palm, fingers, or thumb of the player's racquet holding hand are applied when the handle is gripped with either an Eastern forehand or Eastern backhand grip, or by a Continental grip lying midway between those grips.

Exemplary angular positions for the two arms of the guide surface of the grip guide are disclosed, as well as preferred embodiments in which the side walls providing the guide surfaces of the grip guide extend not only across the top planar surface and across the first beveled planar surface of the racquet handle, but also adjacent the rear planar surface and the second beveled planar surface of the handle. Guide surfaces that lean toward the free end of the racquet handle, with outer portions extending toward that free end farther than the inner portions of the surfaces do, are also disclosed.

An embodiment of the grip guide is disclosed in the form of an elongated shell with a longitudinally aligned concave undersurface arranged to grip the racquet handle with a reliable, non-skid contact when the shell is positioned on the handle.

The elongated shell also has a correspondingly aligned outer surface, and a central longitudinal axis on each side of which a side portion extends laterally outward to form the concave undersurface. The forward end of the elongated shell terminates in a guide surface in the approximate shape of a rounded "V" having two arms, each of which arms slants away from the forward end of the shell in the opposite lateral directions on either side of the longitudinal axis of the shell.

The longitudinally aligned outer surface of the elongated shell is free of any elongated depressions oriented transverse to the central longitudinal axis of the shell. In the embodiment disclosed, the longitudinally aligned outer surface of the shell is not only free of such transversely oriented depressions but is substantially smooth.

Fabrication of the nonplanar bottom of the grip guide (such as the concave undersurface of the elongated shell just mentioned) from a firm, resilient material is disclosed. With such a bottom, if the grip guide of this invention is primarily designed for indicating an Eastern backhand grip for ground strokes and serves, the grip guide can nevertheless be rotated any desired angular distance around the racquet handle to position it in the proper location for other shots as well—such as serves when a grip other than an Eastern backhand grip is used, volleys, and Continental forehand or backhand ground strokes—and the non-skid contact of the grip guide with the racquet handle will still be maintained.

BRIEF DESCRIPTION OF THE DRAWINGS

The invention will now be described by reference to the accompanying drawings, in which:

FIG. 1 is a transverse cross section of the handle of a tennis racquet, showing the various elongated, rectangular planar surfaces that define the racquet handle;

FIG. 2 is a side elevation of the racquet holding hand of a right-handed tennis player, showing the "V"-shaped gap between the thumb and index finger;

FIG. 3 is a top plan view on a reduced scale of a right-handed tennis player's hand holding a tennis racquet with a conventional Eastern backhand grip;

FIG. 4 is a fragmentary top plan view of a right-handed tennis player's hand holding a tennis racquet with a conventional Eastern backhand grip;

FIG. 5 is a three-quarters view of the tennis racquet handle and hand of FIG. 4, with the racquet and hand having been rotated one-eighth turn from their positions in FIG. 4;

FIG. 6 is a side elevation view of the tennis racquet handle and hand of FIG. 4, with the racquet and hand having been rotated one-quarter turn from their positions in FIG. 4;

FIG. 7 is a three-quarters side view of one embodiment of the grip guide of this invention for use by a right-handed player, showing the concave under-surface of the grip guide;

FIG. 8 is a three-quarters view from below and from the other side of the grip guide of FIG. 7;

FIG. 9 is a fragmentary three-quarters view of a tennis racquet with the grip guide of FIGS. 7 and 8 secured in place upon the racquet handle in a position to guide a right-handed player's racquet holding hand to assume a conventional Eastern backhand grip;

FIG. 10 is a top plan view of the tennis racquet handle and grip guide of FIG. 9, with the handle and grip guide having been rotated one-eighth turn from their positions in FIG. 9;

FIG. 11 is a three-quarters view of the tennis racquet handle and grip guide of FIG. 9, with the handle and grip guide having been rotated one-quarter turn from their position in FIG. 9;

FIG. 12 is a side elevation view of the tennis racquet handle and grip guide of FIG. 9, with the handle and grip guide having been rotated a three-eighths turn from their positions in FIG. 9;

FIG. 13 is fragmentary three-quarters perspective view of the tennis racquet handle and grip guide of FIG. 9 taken from the free end of the racquet handle, with the top planar surface of the handle parallel to the surface of the tennis court;

DETAILED DESCRIPTION OF SEVERAL EMBODIMENTS

Figure 14:
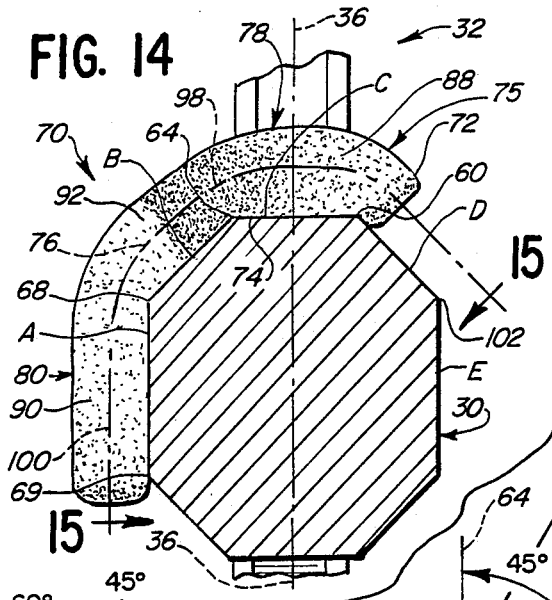
FIG. 14 is an enlarged fragmentary cross section of the racquet handle and grip guide of FIG. 10, taken along the line 14-14 in that Figure, with the attaching band of the grip guide omitted for clarity.

Several embodiments of the tennis grip guide of this invention will now be described, and the manner in which the grip guide can be used with a conventional tennis racquet will be explained.

Conventional Tennis Racquet Handle

FIG. 1 is a transverse cross sectional view of the handle 30 of a conventional tennis racquet 32. In this Figure, the racquet handle is in a horizontal position, with the racquet face perpendicular to the ground.

A top plan view of racquet 32 is given in FIG. 3. As there shown, the racquet extends from handle 30 at one end to flat ball striking head 34 at the other. Racquet head 34 has a median plane 36—36 extending through the center thereof.

The outer surface of the racquet handle 30 is defined by eight rectangular planar surfaces. These planar surfaces include, among others, surfaces A, B, C, D, and E. Rear planar surface A, as best seen in FIGS. 1, 3 and 4, is parallel to median plane 36—36 of racquet head 34, and is located on the side of racquet 32 opposite racquet face 38 which contacts the tennis ball in a backhand shot.

The other rectangular planar surfaces B through E are also seen in FIGS. 1, 3 and 4 disposed in succession around the circumference of racquet handle 30. First beveled planar surface B joins rear surface A and top planar surface C, the latter surface being disposed perpendicular to racquet head median plane 36—36. Second beveled planar surface D adjoins top planar surface C on the opposite side thereof from first beveled planar surface B. Planar surface D adjoins front planar surface E, which is parallel to median plane 36—36 of racquet head 34 and is located on the same side of the racquet as racquet face 38 which contacts the ball in a backhand shot.

Player's Racquet Holding Hand

As is well known, in order to make various types of shots in tennis effectively, it is necessary for the player Lo place his or her racquet holding hand in the proper longitudinal and circumferential positions on the handle of the racquet. These positions can be described, at least approximately, by reference to the structure of the racquet holding hand.

FIG. 2 shows a right-handed player's racquet holding hand 40 in the approximate position of the hand when the player is prepared to grasp the racquet handle to make an Eastern forehand shot. This position is sometimes referred to by tennis coaches and teaching professionals as the "shaking hands" position.

As will be seen from FIG. 2, the portion of the player's hand that is located between base knuckle 42 of thumb 44 and base knuckle 46 of index finger 48 defines gap 50 having the approximate shape of an unequal sided "V". In this Figure, imaginary unequal sided "V" 52 is drawn in a location spaced inward from the actual gap 50, in order to emphasize the approximate shape of the gap. Longer arm 54 of this imaginary "V" 52 lies adjacent base knuckle 46 of index finger 48, and shorter arm 56 of "V" 52 lies adjacent base knuckle 42 of thumb 44. Similar real portions of the player's hand form the actual gap in the hand between thumb base knuckle 42 and index finger base knuckle 46.

Eastern Backhand Grip

FIGS. 3 and 4 give two top views of a right-handed player's hand gripping the racquet handle in the conventional position for an Eastern backhand shot. (FIG. 3 is drawn on a reduced scale in order to show the entire tennis racquet 32, including racquet head 34.) FIGS. 5 and 6 give additional views of a player's hand gripping the racquet handle in the conventional position for an Eastern backhand shot, from a three-quarters view and from the side 57 of the racquet head that faces to the rear in a backhand shot, respectively.

One definition of the proper position for the player's hand in a conventional Eastern backhand grip that is employed by a number of tennis coaches and teaching professionals involves two steps. First, the player is instructed as to how to place the racquet holding hand on the racquet handle in the proper position for Eastern forehand shots by (1) supporting the racquet in the other hand with the racquet head perpendicular to the ground, (2) extending the racquet holding hand forward as if to shake hands with someone, and (3) then grasping the racquet handle with the latter hand while keeping the head of the racquet parallel to the palm of that hand. Second, the player is instructed to move his or her hand from the Eastern forehand grip into the Eastern backhand grip by rotating the hand around the handle about one-eighth turn i.e., about 45° in the counterclockwise direction (for a right-handed player) as seen from the free end of the racquet handle. (When this turn is described as a "one-quarter turn," as it sometimes is, this refers to one-quarter of the angular distance from the top panel to the bottom panel of the surface of the racquet handle.)

One way of checking to see if the player's hand is in the proper position for an Eastern backhand shot is to check the positions of (1) heel 58 and (2) base knuckle 46 of index finger 48 cf hand 40 (FIGS. 2–6). This method of checking is explained, for example, at page 18 of *Tennis Strokes & Strategies* (1975) published by *Tennis Magazine*. As there pointed out, in a proper Eastern backhand grip for a right-handed player the heel of the hand (designated as part 58 in FIG. 6) is partly on the left bevel B of racquet handle 30, with the rest of the hand protruding off the edges just a bit. In addition, base knuckle 46 of index finger 48 lies on right-hand edge 60 of top planar surface C (FIG. 4).

As an additional check point for a proper Eastern backhand grip, it is sometimes mentioned by coaches and teaching professionals that (as shown in FIG. 5) the bottom of the approximate "V"-shaped gap 50 between thumb base knuckle 42 and index finger base knuckle 46 of the player's racquet holding hand 40 should be positioned generally adjacent first beveled planar surface B of the racquet handle.

It can be observed from FIGS. 4 through 6 that in a proper Eastern backhand grip one possible angular location of first segment 62 of the player's index finger 48 with respect to edges 64 and 60 of top planar surface C (whatever the location of the bottom of "V"-shaped gap 50 between base knuckles 42 and 46 may be) is approximately 45°. Other angular locations for index finger segment 62 may result from the use of the various check points already mentioned (and perhaps other check points) by particular players, coaches or teaching professionals.

In addition to the effect of the use of these check points, the angular location of finger segment 62 will be affected by still other variables. Thus, this will depend in part (as indicated in FIG. 4) upon the angular position 66 of the player's hand 40 with respect to median plane 36—36 of racquet 32 that is preferred by player, coach or teacher, and this angular position will be influenced in turn by the preferred angle of the player's forearm with respect to that median plane that is present at the moment the ball is struck in a backhand shot. Moreover, if the player's preference is to use a somewhat larger or smaller handle than is generally recommended for the player's particular hand size, the angular location of first segment 62 of the index finger may be influenced by the circumferential diameter of the racquet handle. In addition, it may be affected by the exact angles between the eight planar surfaces that define the racquet handle or by the relative widths of those eight planar surfaces (which angles and relative widths may vary somewhat from one racquet to another), or even by the particular type of gripping surface utilized for the handle.

Depending upon the various factors that have been mentioned, and the particular preferences of the player, coach or teaching professional with respect to various decisions as to how best to execute Eastern backhand shots, the angular position of index finger segment 62 may vary (as indicated in FIG. 4) over a range as great as from about 30° to about 75° with respect to edges 64 to 60 of top planar surface C of the racquet handle.

The angular location of the first segment 67 of the player's thumb 44 with respect to rear planar surface A of racquet handle 30 in an Eastern backhand grip can vary as widely as the angular location of the first segment 62 of the index finger. Occasionally a coach or teaching professional will recommend that the thumb be extended along rear planar surface A of the racquet handle in a location slanting sharply away from the free end of the handle, even to the point of lying alongside that rear planar surface in a position virtually parallel to the longitudinal axis of the handle. However, it is usually considered that the most useful angle at which first segment 67 of thumb 44 immediately beyond base knuckle 42 should slant away from the free end of racquet handle 30 is from just less than 90° to about 30° in relation to the edges 68 and 69 of rear planar surface A of handle 30. (See, for example, FIGS. 5 and 6.)

The angular positioning of first segment 62 of the player's index finger 48 just beyond base knuckle 46 is often referred to (as in the Wright and Bertucci patents discussed above) in connection with achieving the proper grip for forehand shots, but so far as applicants are aware that angular location is not ordinarily mentioned (if indeed it is mentioned at all) as a check point for a proper grip for Eastern backhand shots. The angular location of first segment 67 of the player's thumb 44 is sometimes referred to by coaches and teaching professionals as a check point for the proper position of the player's racquet holding hand for an Eastern backhand shot, but as suggested above, this is frequently left to the preference of the individual player.

In any event, so far as applicants are aware, no prior art devices for indicating the proper positioning of the player's hand for backhand shots have provided guide surfaces for (1) the location of the bottom of the "V"-shaped gap in the player's racquet holding hand, (2) the angle at which the first segment of the player's index finger extends around the racquet handle, and (3) the angle at which the first segment of the player's thumb extends in the other direction around the handle. It appears that if it ever did occur to any worker in this art to try to utilize these three guide surfaces in a grip guide device, the variation from one player's hand to another's in the structure of the part of the hand between the thumb and forefinger may superficially have seemed to be so great as to make the guide surfaces just mentioned too unreliable to be safely utilized.

Whatever the reason may have been, so far as is known to applicants no one prior to their invention thought to utilize the kinds of guide surfaces applicants have employed to guide the player's hand into the conventional Eastern backhand grip or other types of grips as desired. Applicants have determined that however great the superficial variation in different players' hands may be, the underlying bone structure of those hands is similar enough to provide a good basis for guiding the racquet holding hand of most, if not all, players into the proper position for various types of shots. Applicants' grip guide thus makes use of the underlying bone structure of the racquet holding hand in a unique and unexpected way to position the hand properly upon the racquet handle.

In spite of all the very active research in past years directed toward improved tennis racquet grips and grip guides, which has extended over almost a century, no one prior to applicants, so far as they know, has ever developed a grip guide that has employed the unique construction, or has achieved the many important advantages, of, the grip guide of this invention.

Construction Of First Embodiment Of Grip Guide of This Invention

FIG. 7 is a three-quarters side view of one embodiment 70 of the grip guide of this invention, for use by a right-handed player, that provides stop means in the form of an elongated shell 72 with a nonplanar bottom or concave undersurface 74 and an outer surface 75. Shell 72 includes central longitudinal axis 76—76, first side portion 78, and second side portion 80. One of these side portions extends outward from central axis 76—76 on each side of the axis to form longitudinally aligned concave undersurface 74. Outer surface 75 is longitudinally aligned in a manner corresponding to the longitudinal alignment of concave undersurface 74. Side portions 78 and 80 are arranged to grip the racquet handle with a reliable, non-skid contact when shell 72 is positioned on the handle.

Attaching means **82*a* and 82*b* are provided for securing elongated shell 72 to the racquet handle, with concave undersurface 74 positioned along the handle at least adjacent the top planar surface and first beveled planar surface (such as planar surfaces C and B, respectively, in FIGS. 1 and 3–6) of the handle. In this position on the handle, forward end 84 of shell 72 extends in the direction of the free end of the racquet handle, such as 86 in FIGS. 3–6**.

In the embodiment shown, securing means **82*a* is a band or strap that may be wrapped around the bottom of the racquet handle, passed through clasp means 82*b*, and wrapped in the opposite direction around the handle again to bear against itself. In this embodiment, the undersurface of band 82*a*** is formed of a myriad of small hooks, and the top surface is formed of a myriad of tiny eyelets, in the manner employed in a conventional fastening means sold under the trademark VELCRO.

Elongated shell 72 terminates at its forward end 84 in a guide surface or stop means, in the approximate shape of an unequal sided, rounded "V" with its bottom end 92, when the grip guide is secured in place on the racquet handle, being spaced from and arranged to face toward free end 86 of the handle. In the embodiment of FIG. 7, the unequal sided, rounded "V" is formed of longer arm 88 at the end of first side portion 78 and shorter arm 90 at the end of second side portion 80, each arm forming a stop means or guide surface for a particular portion of the player's racquet holding hand. The guide surface in the approximate shape of a rounded "V" is free of any projection extending in the forward direction away from the guide surface. This is important (as will be explained below) in maintaining the entire surface of the racquet handle between the guide surface at forward end 84 of elongated shell 72 and the end of the racquet handle free of any obstruction to rotation of the player's hand from one position on the handle to another.

When grip guide 70 is positioned on handle 30 of tennis racquet 32, bottom 92 of rounded "V" 88/90 is positioned adjacent first beveled planar surface B of the racquet handle. In this position, both arms 88 and 90 slant away from free end 86 of racquet handle 30 as one moves in opposite circumferential directions around the handle from central longitudinal axis 76—76 of shell 72. Shorter arm 90 of the unequal sided, rounded "V" extends toward rear planar surface A of handle 30, and longer arm 88 extends towards second beveled planar surface D of the handle. Arm 90 slants away from free end 86 of the racquet handle less sharply than does arm 88.

FIG. 8 is another view of grip guide 70 from below, showing concave undersurface 74 of elongated shell 72. As in FIG. 7, shell 72 includes central longitudinal axis 76-76, first side portion 78, and second side portion 80.

Attaching means 82*a* and 82*b* are provided for securing the shell to the racquet handle.

The guide surface at forward end 84 of shell 72, in the form of an unequal sided rounded "V", includes arms 88 and 90.

Positioning Of First Embodiment Upon Racquet Handle For Eastern Backhand Grip

FIGS. 9–14 give various views of grip guide 70 positioned upon handle 30 of racquet 32 in a manner to indicate the proper position of a right-handed player's hand for a conventional Eastern backhand shot. In all these Figures, grip guide 70 is secured to racquet handle 30 in the same manner as described above, by band 82*a* which has been wrapped around upon itself after having been passed through clasp 82*b*. In this manner nonplanar bottom or concave undersurface 74 of elongated shell 72 is caused to grip racquet handle 30 with a reliable, non-skid contact.

FIG. 9 is a three-quarters view looking directly at second beveled planar surface D, with racquet 32 having been rotated one-eighth turn counterclockwise (as viewed from free end 86 of racquet handle 30) from the position in which the head of racquet 32 is perpendicular to the ground. FIGS. 10 through 12 provide additional views after racquet 32 and grip guide 70 have been rotated by successive one-eighth turns in the clockwise direction (as viewed from free end 86 of handle 30) to show the position of the grip guide when it indicates the proper grip for an Eastern backhand shot.

In FIG. 9, longer arm 88 of guide surface 88/90 extends at an angle of about 45° to edges 64 and 60 of top planar surface C of racquet handle 30, and for a short distance adjacent second beveled planar surface D at the same angle of about 45° with respect to edge 60 between planar surfaces C and D. Bottom 92 of the unequal sided, rounded "V" 88/90 is adjacent first beveled planar surface B, directly below that surface in this Figure.

In FIG. 10, with racquet handle 30 and grip guide 70 rotated one-eighth turn in the clockwise direction (as seen from free end 86 of the handle) from their positions in FIG. 9, guide surface 88 is seen to be also at about 45° to edge 64 between top planar surface C and first beveled planar surface B for a distance of about two-thirds the width of planar surface B. Bottom 92 of rounded "V" 88/90 is positioned closer to edge 68 of first beveled planar surface B that borders rear planar surface A of the racquet handle than it is to edge 64 on the other side of planar surface B. In this Figure, first side portion 78 of shell 72 has moved upward in the Figure from the position shown in FIG. 9, and second side portion 80 of the shell has rotated into view at the bottom of the Figure.

In FIG. 11, racquet handle 30 and grip guide 70 have been rotated an additional one-eighth clockwise turn as seen from free end 86 of the handle. In this position, bottom 92 of rounded "V" 88/90, which is located approximately at central longitudinal axis 76-76 of elongated shell 72, is again seen to be positioned closer to bottom edge 68 than to top edge 64 of first beveled planar surface B. In this Figure, first side portion 78 of shell 72 is seen at the top of the Figure, and a larger portion of second side portion 80 of the shell than was seen in FIG. 10 is visible at the bottom of the Figure because of the one-eighth clockwise turn given the handle and grip guide between FIGS. 10 and 11. Guide surface 90 extends at approximately 85° to edges 68 and 69 of rear planar surface A of racquet handle 30.

In FIG. 12, racquet handle 30 and grip guide 70 have again been rotated ore-eighth turn in the clockwise direction as viewed from free end 86 of the racquet handle. Bottom 92 of rounded "V" 88/90 and central longitudinal axis 76—76 are still visible adjacent first beveled planar surface B, nearer to edge 68 than to edge 64 of that planar surface. First side portion 78 of shell 72, which terminates in guide surface 88, is still partly seen at the top of the Figure, and second side portion 80 of the shell, which terminates in guide surface 90, is seen in the middle portion of the Figure. A fuller view of guide surface 90, extending at approximately 85° to edge portions 68 and 69 of rear planar surface A, is of course seen in this Figure than was visible in FIG. 11.

FIGS. 13 and 14 illustrate how elongated shell 72 extends along racquet handle 30 at least adjacent top planar surface C and first beveled planar surface B of the handle, with the forward end 88/90 of the shell extending in the direction of free end 86 of the racquet handle. First section 78 lies adjacent both top planar surface C and second beveled planar surface D of racquet handle 30, and second section 80 lies adjacent both planar surface B and rear planar surface A of the racquet handle. Concave undersurface 74 is positioned along handle 30.

Bottom 92 of rounded "V" 88/90 is seen to be positioned at about the same location as longitudinal central axis 76—76, positioned closer to edge 68 of first beveled planar surface B than to the other edge 64 of that planar surface. Bottom 92 of rounded "V" 88/90 and longitudinal central axis 76—76 may be positioned closer to edge 68 than is shown in FIGS. 13 and 14, or even a slight distance on the other side of edge 68 (still adjacent first beveled planar surface B of the racquet handle) if a particular player, coach or teaching professional prefers such an extreme rotation of the hand for backhand shots.

FIG. 14 shows the same parts (except for band 82*a*, which is omitted for clarity), with the same relationship between those parts, as are shown in FIG. 13, in a cross-sectional view taken along line 14—14 of FIG. 10 instead of the perspective view of FIG. 13. In addition, FIG. 14 shows line 15—15 along which a cross section of elongated shell 72 is taken through the middle portion of the elongated shell, parallel to concave undersurface 74 of the shell.

In this Figure, the grip guide is in position to indicate the Eastern backhand grip for a right-handed player, with concave undersurface 74 of elongated shell 72 shaped to contact racquet handle 30 substantially throughout the area of the undersurface.

In FIG. 14, guide surfaces 88 and 90 comprise a side wall having a tapered cross section 98 taken along line 15—15 just identified. This tapered cross section has the approximate shape of an unequal sided, rounded "V" with its open end facing away from free end 86 of racquet handle 30.

As seen from FIGS. 9 through 14, elongated shell 72 is configured such that substantially the entire surface of racquet handle 30, from the slanting guide surfaces 88 and 90 in the approximate shape of a rounded "V" at forward end 84 of the elongated shell to free end 86 of handle 30, is free of any obstruction.

Figure 15:
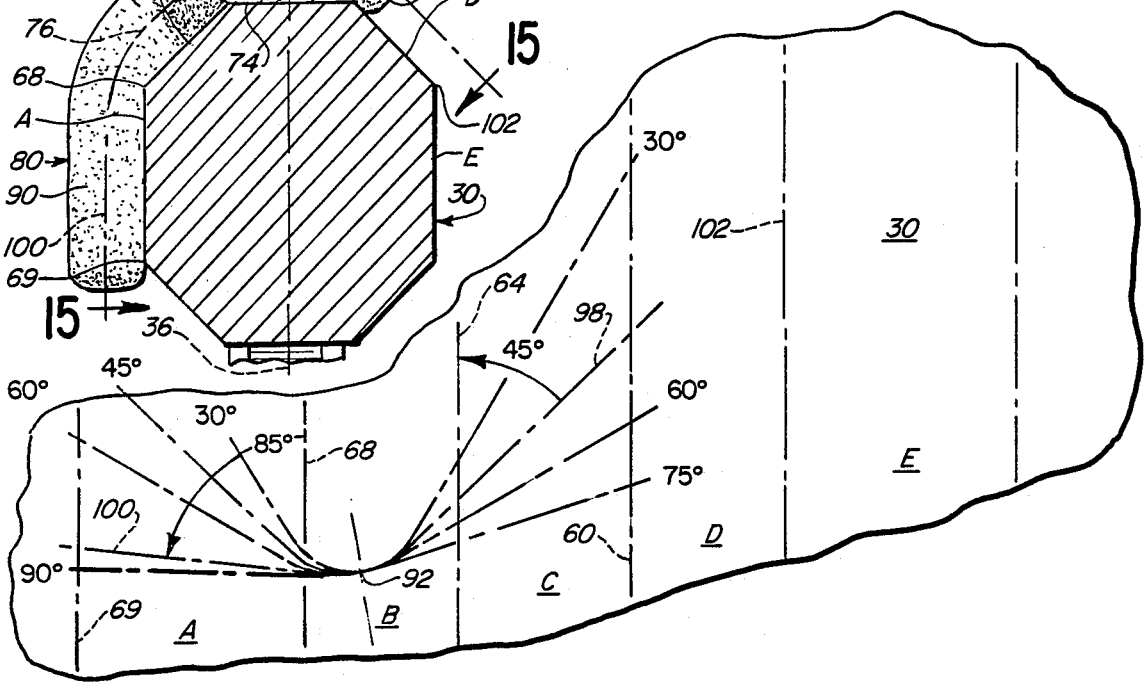
FIG. 15 is a developed cross-sectional view of the location lines of the side walls of the grip guide of FIG. 14, taken parallel to the bottom surface of the grip guide through its middle portion along the line 15—15 in the latter Figure, showing several possible positions of the side walls with respect to planes A through E that define the surface of the racquet handle.

FIG. 15 shows, among other things, a developed view of the cross sections of guide surfaces 88 and 90 taken along line 15—15 of FIG. 14. Location line 98, which extends from bottom 92 of the rounded "V"-shaped cross section at an angle of approximately 45° to edges 64 and 60 of top planar surface C, represents the cross section of guide surface 88. Shorter location line 100, extending from bottom 92 of rounded "V"-shaped cross section 88/90 at approximately 85° to edges 68 and 69 of rear planar surface A, represents the cross section of guide surface 90. As seen, guide surface 90 slants away from free end 86 of racquet handle 30 less sharply than does arm 88.

Other angular locations of guide surface 88 for the index finger of the player's racquet holding hand are also indicated in FIG. 15 at, for example, 30°, 60° and 75° to edges 64 and 60 of top planar surface C of the racquet handle. Likewise, additional possible angular location for guide surface 90 adjacent the player's thumb are indicated in FIG. 15 at, for example, 30°, 45°, 60° and slightly less than 90° to edges 68 and 69 of rear planar surface A.

As will be seen from FIG. 15, cross section 98 of guide surface 88 of elongated shell 72, which may also be thought of as the cross section of the side wall of a stop means, is the longer arm of a figure having the approximate shape of an uneven sided, rounded "V" extending circumferentially across top rectangular planar surface C of the racquet handle at a first predetermined acute angle with respect to the sides of the top rectangular surface. Similarly, cross section 100 represents the shorter arm of that unequal sided, rounded "V" that extends circumferentially across first beveled planar surface B for a short distance, and then farther across rear planar surface A of the handle.

As will be seen from a comparison of FIGS. 4–6 on the one hand with FIGS. 9–13 on the other hand, guide surfaces 88 and 90, respectively, provide guide stops for (1) base knuckle 46 of the player's index finger 48, (2) portion 50 of the player's hand 40 that defines the gap between the base knuckles of the player's index finger 48 and thumb 44, and (3) base knuckle 42 of the player's thumb. The respective angles at which the stop means or guide surface at the forward end of the grip guide of this invention extends in opposite directions around racquet handle 30 may be employed in the grip guide of this invention to provide a guide for whatever precise position of the player's racquet holding hand is desired for an Eastern backhand grip, according to the preference of the coach, the teaching professional or the player.

Positioning Of First Embodiment Upon Racquet Handle For Continental Grip

Figure 16:
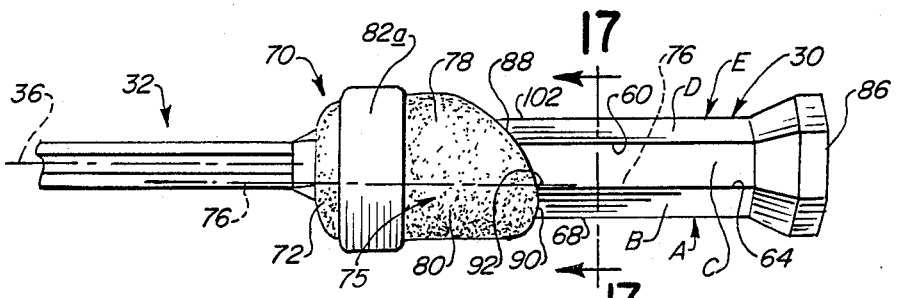
FIG. 16 (on the same sheet with FIGS. 20–24) is a top plan view of the grip guide of FIG. 10 in place upon a tennis racquet handle after it has been rotated approximately one-sixteenth turn around the handle in the clockwise direction (as seen from the free end of the handle), into a position to guide a right-handed player's racquet holding hand to assume a conventional Continental grip.

FIG. 16 (on the same sheet with FIGS. 20–24) is a top plan view of grip guide 70 positioned upon racquet handle 30 to indicate the proper location of a right-handed player's hand for executing shots with a Continental grip. In this Figure, elongated shell 72 has been rotated on racquet handle 30 (keeping the racquet stationary) approximately one-sixteenth turn in the clockwise direction (as seen from the free end of racquet handle 30) from the position the shell occupied in FIG. 10. In this position, central longitudinal axis 76—76 and bottom 92 of unequal sided, rounded "V" 88/90 are positioned adjacent edge 64 of first beveled planar surface B of racquet handle 30, which edge also borders top planar surface C of the handle.

Figure 17:
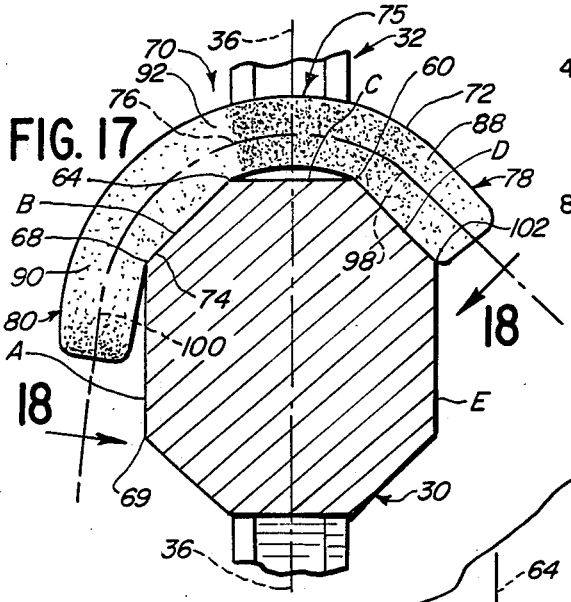
FIG. 17 is an enlarged fragmentary cross section of the racquet handle and grip guide of FIG. 16, taken along the line 17—17 in that Figure, with the attaching band of the grip guide omitted for clarity.

FIG. 17 is an enlarged transverse cross-sectional view of grip guide 70 and racquet handle 30 taken along line 17—17 in FIG. 16. As will be seen from FIG. 17, in this position of elongated shell 72, bottom 92 of rounded "V" 88/90 and central longitudinal axis 76—76 of the shell are located just above edge 64 between first beveled planar surface B and top planar surface C of racquet handle 30, but if desired they may be positioned next to planar surface B, so long as they are adjacent edge 64 of that surface.

Figure 18:
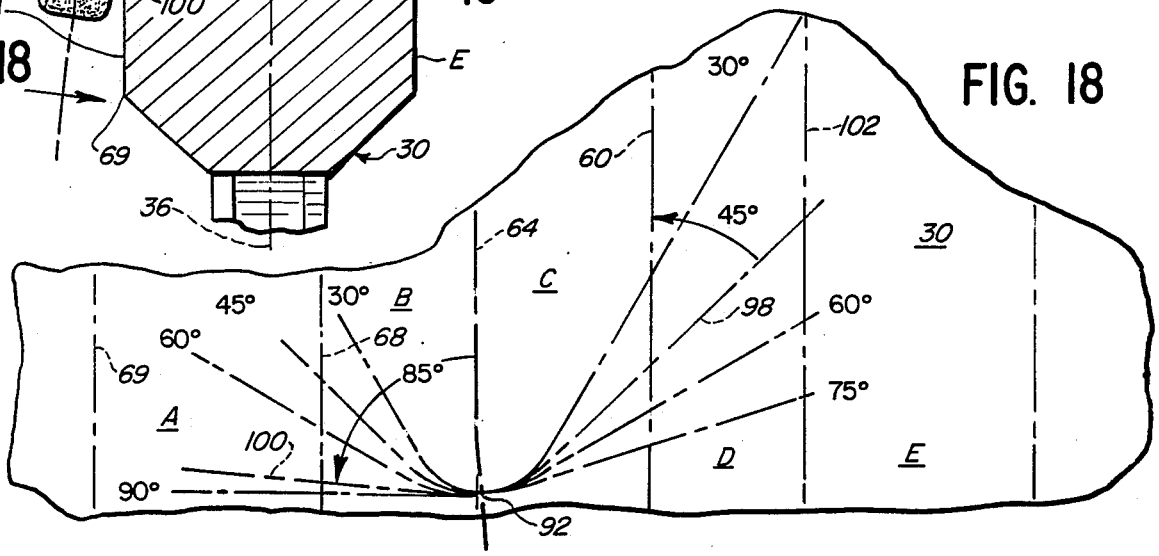
FIG. 18 is a developed cross-sectional view of the location lines of the side walls of the grip guide of FIG. 17, taken parallel to the bottom surface of the grip guide through its middle protion along the line 18—18 in the latter Figure, showing several possible positions of the side walls with respect to planes A through E that define the surface of the racquet handle.

FIG. 18 is a developed cross-sectional view of location lines 98 and 100 of guide surfaces 88 and 90, respectively, showing the locations of those lines with respect to planar surfaces A through E of racquet handle 30, when grip guide 70 is secured to racquet handle 30 in the position shown in FIGS. 16 and 17. As will be seen, location line 98 has the same angular position in FIG. 18 with respect to edges 60 and 102 of planar surfaces C and D as it has in FIG. 17 with respect to edges 64 and 60 of planar surfaces B and C, respectively, and location line 100 has the same angular position with respect to edges 64, 68 and 69 of planar surfaces B and A as it does with respect to edges 68 and 69 of planar surface A in FIG. 15.

FIG. 18 also shows the above described location of bottom 92 of rounded "V"-shaped guide surface 88/90.

As will be seen, when grip guide 70 is in the position shown in FIGS. 16 and 17 to indicate the proper position for a Continental grip, guide surface 88 (as shown by cross-sectional location line 98) lies at approximately 45° to edges 60 and 102 of second beveled planar surface D of racquet handle 30. In this position of elongated shell 72, guide surface 90 (as shown by cross-sectional location line 100) lies at approximately 85° to edge 68 between first beveled planar surface B and rear planar surface A.

Other possible locations for the guide surface for the index finger of the player's racquet holding hand are indicated in FIG. 18 at 30°, 60° and 75° in relation to edges 60 and 102 of second beveled planar surface D of the racquet handle. Likewise, other possible locations for the first segment of the player's thumb are indicated ar 30°, 45°, 60° and at just less than 90° to edge 68 of rear planar surface A.

Concave undersurface 74 cf elongated shell 72 is formed of firm, resilient material. The shell may be integrally formed of the same material throughout, or the firm, resilient material of which the concave undersurface is formed may if desired be laminated to the remainder of the shell. In either event, with grip guide 70 rotated into the position it occupies in FIG. 17, side portions 78 and 80 continue to grip racquet handle 30 with a reliable, non-skid contact.

If a grip guide that is primarily for indicating the proper position of the player's hand for the Continental grip is desired, the elongated shell should be shaped initially to contact racquet handle 30 substantially throughout the area of the undersurface, in the same manner as is shown for an Eastern backhand grip guide in FIG. 14.

Second Embodiment

Figure 19:
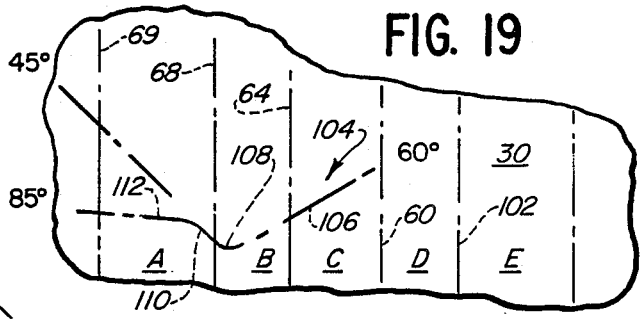
FIG. 19 is a developed cross-sectional view on a reduced scale of the location lines of the side walls of a second embodiment of the grip guide of this invention (for use by a right-handed player) in place upon a tennis racquet handle such as shown in FIGS. 14 and 17, taken parallel to the bottom surface of the grip guide through its middle portion, showing the positions of the side walls of this second embodiment with respect to planes A through E that define the surface of the racquet handle.

FIG. 19 is a developed cross-sectional view on a smaller scale of the location lines of the guide surfaces at the forward end of a second embodiment of the grip guide of this invention for use by a right-handed player.

In this second embodiment, the guide surface at the forward end of the grip guide facing free end 86 of racquet handle 30 has the shape of a distorted, unequal sided, rounded "V" 104. In this embodiment, location line 106 indicates the position of the guide surface for base knuckle 46 and first segment 62 of the player's index finger 48. This guide surface extends circumferentially around racquet handle 30 from rounded bottom 108 of distorted "V" 104 at an angle of approximately 60° to edges 64 and 60 of top planar surface C of the racquet handle.

The other, shorter arm of distorted "V" 104 provides guide surface 110/112 for base knuckle 42 and first segment 67 of the player's thumb 44. Inner portion 110 of this guide surface immediately adjacent bottom 108 extends from bottom 108 in the generally opposite direction from that in which location line 106 extends. It lies at approximately 45° to edge 68 of rear planar surface A of the racquet handle. The next or middle portion 112 of this guide surface, which is farther from bottom 108 than inner portion 100 is, extends along rear planar surface A slanting away from free end 86 of racquet handle 30 at a smaller predetermined acute angle than guide surface 106 does. In the embodiment shown, location line 112 for the middle portion of this guide surface extends at an angle of approximately 85° to edges 68 and 69 of rear planar surface A.

In this second embodiment of the grip guide of this invention, the guide surface on the thumb side of bottom 108 of distorted "V" 104 provides two stop means. Location line 110 indicates a guide surface that provides a stop means for base knuckle 42 of thumb 44 of the player's hand. Location line 112 indicates a guide surface that provides a stop means for first segment 67 of the player's thumb just beyond base knuckle 42.

Third Embodiment

Figure 20:
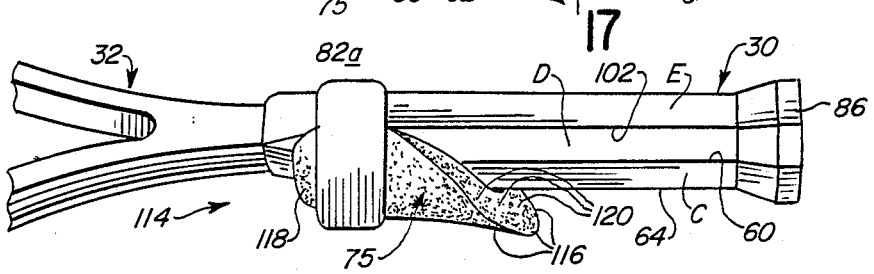
FIG. 20 is a three-quarters side view of a third embodiment of the grip guide of this invention (for use by a right-handed player) positioned upon a tennis racquet handle.

FIG. 20 is a three-quarters side view of a third embodiment 114 of the grip guide of this invention positioned upon racquet handle 30, again for use by a right-handed player. Racquet 32 is in the same position in this Figure as in FIG. 9 discussed above.

This third embodiment 114 is generally similar in construction to first embodiment 70 of the grip guide, with the exception that outer portions 116 of the guide surface at the end of the elongated shell 118 facing toward free end 86 of racquet handle 30, which are spaced from the handle, provide an overhang that abuts the approximately "V"-shaped gap 50 of the player's racquet holding hand. Put another way, these outer portions 116 of racquet handle 30, which are spaced from the handle, extend toward free end 86 of racquet handle 30 farther than do inner portions 120 of shell 118 which are located adjacent the racquet handle.

Fourth Embodiment

Figure 21:
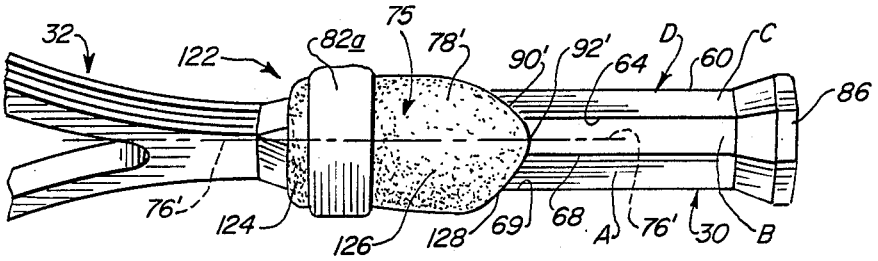
FIG. 21 is a three-quarters side view from the opposite side of a tennis racquet, showing a fourth embodiment of the grip guide of this invention (also for use by a right-handed player) in position upon the racquet handle.

FIG. 21 is a three-quarters side view showing a fourth embodiment 122 of the grip guide of this invention, also for use by a right-handed player, in position upon racquet handle 30. Racquet 32 is in the same position in this Figure as in FIG. 11 discussed above.

First side portion 78', guide surface 88', and bottom 92' of the "V"-shaped free end of the grip guide are substantially the same as in first embodiment 70 described above. "V" bottom 2' and central longitudinal axis 76'—76' are both located in substantially the same positions in this embodiment 122 as in embodiment 70, adjacent first beveled planar surface B and located nearer edge 68 than edge 64 of that surface.

Second side portion 126 terminates in guide surface 128, which slants away from free end 86 of racquet handle 30 more sharply than does guide surface 90 in embodiment 70. However, guide surface 128 still slants away from free end 86 of the racquet handle less sharply than does guide surface 88' at the free end of first side section 78' of shell 124.

As will be seen, grip guide 122 embodies the basic concept of this invention, with a variation in the specific shape of the unequal sided, rounded bottom "V" guide surface at the free end of the grip guide facing end 86 of the racquet handle.

Other Embodiments

As will be apparent to those skilled in the art, the guide surface for the base knuckles 42 and 46 of the player's index finger 48 and thumb 44, respectively, and for gap 50 between those base knuckles, may have, if it is desired, still other configurations.

The minimum guide surfaces providing an indication of the proper longitudinal and circumferential positioning of the player's hand for a conventional Eastern backhand shot should include guide surfaces for at least (1) base knuckle 42 of thumb 44, and (2) approximate "V"-shaped gap 50 of the player's hand 40, and the guide surface should extend entirely across first beveled planar surface B and at least part way across top planar surface C of racquet handle 30.

A modification of the second embodiment described above and illustrated in FIG. 19 will provide one example of such a minimum grip guide. Such modification might include a short arm extending in the counterclockwise direction (as seen from free end 86 of the racquet handle) from bottom 108 of rounded "V" at, say, 60° to edge 64 of beveled planar surface B, but only part way across rear planar surface A without any second portion such as part 112 in FIG. 19. A second, somewhat longer arm for the rounded "V" could extend from "V" bottom 108 in the generally opposite direction from the shorter arm at, say, approximately 45° to edge 64 of beveled planar surface B, but only to perhaps the middle of top planar surface C.

As will be seen, a stop means having guide surfaces as just defined would provide a guide stop for base knuckle 42 of thumb 44 of the player's racquet holding hand 40, and also for the "V"-shaped gap 50 of the player's hand although (as will be seen from FIG. 4) it would not provide a full guide stop for base knuckle 46 of the player's index finger 48 because it would not be extended entirely across top planar surface C of the racquet handle.

Grip Guide Indicates Eastern Backhand Grip Without Interfering With Other Grips With the grip guide of this invention in a position such as indicated in FIGS. 9–15, when the player rotates his or her hand from the proper position for an Eastern forehand shot to grip the racquet handle for an Eastern backhand shot, the approximately "V"-shaped portion 50 of the player's hand between base knuckles 42 and 46 of index finger 48 and thumb 44, respectively, can be caused to abut the rounded bottom "V" guide surface 88/90 of grip guide 70 at the forward end of elongated shell 72. Base knuckles 42 and 46 themselves can likewise be caused to abut guide surface 88/90. This makes it possible for the player quickly and automatically to position his or her hand 40 upon racquet handle 30 with the proper grip for an Eastern backhand shot simply by the feel of grip guide 70 against the player's hand, without looking at the racquet handle or the position of the hand on the handle.

At the same time, it will be seen that (unlike a number of prior art tennis handle grips) the configuration of grip guide 70 is such that when it is secured to racquet handle 30 in the manner described, the entire surface of the racquet handle is left free of any obstruction at all points on that surface from guide surfaces 88 and 90 at forward end 84 of elongated shell 82 to free end 86 of the racquet handle. In other words, there will be no obstruction on the surface of the handle insofar as any areas of that surface are concerned to which the palm, fingers or thumb of the player's racquet holding hand are applied either when the player's hand is positioned on the handle for an Eastern backhand shot, or is moved from there into position for an Eastern forehand shot.

Figure 22:
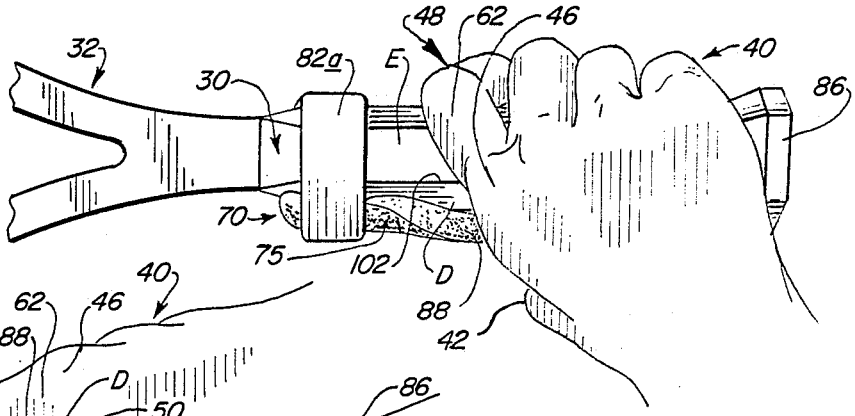
FIG. 22 is a fragmentary side elevation of a tennis racquet handle, with the grip guide of FIG. 9 in position upon the handle, taken from the side of the racquet opposite the racquet face that contacts the ball in a forehand shot, showing a right-handed player's hand in position upon the raquet handle in a conventional Eastern forehand grip.
Figure 23:
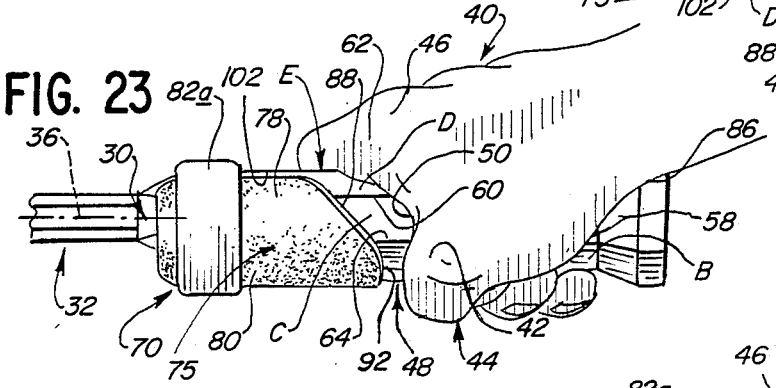
FIG. 23 is a top plan view of the racquet handle, grip guide and player's hand of FIG. 22.
Figure 24:
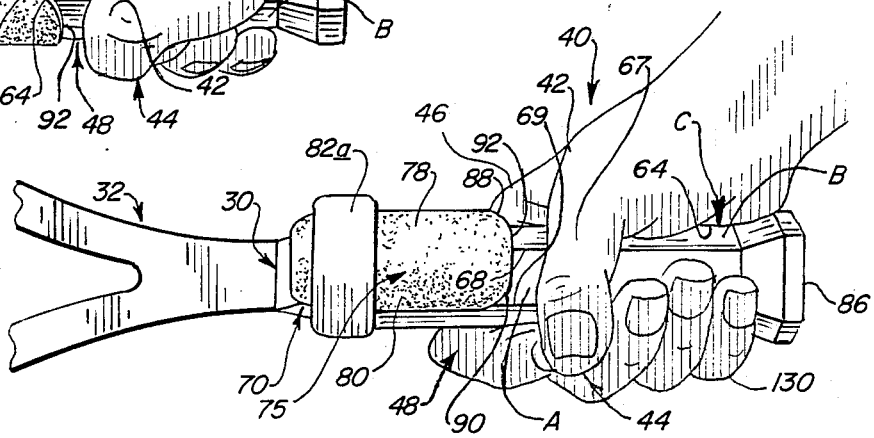
FIG. 24 is a side elevation, from the same side of the racquet as the racquet face that contacts the ball in a forehand shot, of the racquet handle, grip guide and player's hand of FIG. 22.

This latter fact is made clear with respect to the forehand grip by FIGS. 22 and 24, which Figures show the racquet handle as gripped by a right-handed player. FIG. 22 is a fragmentary side elevation of racquet handle 30 with grip guide 70 secured thereto by band 82*a*, taken from side 38 of racquet 32, which is opposite the racquet face (designated 57 in FIG. 3) that contacts the ball in a forehand shot. The player's hand 40 is shown in position upon handle 30 in a conventional Eastern forehand grip. FIG. 23 is a top plan view of racquet handle 30, grip guide 70, and the player's hand 40 of FIG. 22, after both the racquet handle and player's hand have been rotated 90° in the clockwise direction (as seen from free end 86 of the racquet handle). FIG. 24 is a side elevation, taken from the same side of the racquet as the racquet face that contacts the ball in a forehand shot, of racquet handle 30, grip guide 70, and the player's hand 40 of FIG. 22, after the racquet handle and player's hand have both been rotated in the clockwise direction (again, as seen from free end 86 of the racquet handle) a full 180° from the position occupied in the latter Figure.

One way to check to see if the player's hand is in the proper position for an Eastern forehand shot is to check the positions of (1) heel 58, (2) pad 130 of thumb 44, (3) index finger 48, and (4) base knuckle 46 of the index finger of the player's hand 40. This method of checking is explained, for example, at page 17 of *Tennis Strokes & Strategies* (1975) published by *Tennis Magazine*. As there pointed out, in a proper Eastern forehand grip for a right-handed player the heel of the hand (designated 58 in FIG. 23) is on the right bevel D of racquet handle 30, with thumb pad 130 on left vertical panel A (FIG. 24). Index finger 48 is spread slightly away from the other, grouped fingers, with base knuckle 46 of the index finger resting on right vertical panel E (FIG. 22).

As will be seen from FIGS. 22 through 24, with the player's hand 40 in the position just described for Eastern forehand shots, there is no obstruction on the surface of racquet handle 30 in any area to which the palm, fingers or thumb of the player's racquet holding hand are applied in this grip. Similarly, it will be seen from FIGS. 22 through 24 that when the player's hand is rotated on the racquet handle a one-eighth turn in the counterclockwise direction (as seen from free end 86 of racquet handle 30) from the forehand grip position shown in FIG. 23—which will place the hand in the proper position for the Continental grip—"V"-shaped gap 50 between base knuckles 42 and 46 of the hand will be positioned adjacent edge 64 between top planar surface C and first beveled surface B, with no part of the hand in contact with grip guide 70. Because there is no obstruction on the surface of the racquet handle in either the (astern backhand or forehand grips, there is no obstruction when the Continental grip—located midway between those two grips —is to be employed.

Whether the racquet handle is grasped with an Eastern forehand grip, a Continental grip, or an Eastern backhand grip, with the butt of the palm of the player's racquet holding hand in each of these grips at substantially the same distance from free end 86 of racquet handle 30 (as shown by a comparison of FIGS. 6 and 24), it is seen that when the grip guide is secured on the racquet handle to guide the player's hand into the proper position for an Eastern backhand shot there will at no time be any obstruction beneath the player's hand such as is present in certain grip devices of the prior art. Because of the described construction of the grip guide of this invention, any of the three grips mentioned, and any variations thereof, can all be employed with a tennis racquet to which this grip guide has been secured to produce an Eastern backhand grip, and the only time this grip guide will abut the player's hand is when he or she wishes it to—i.e., when the player is hitting a backhand shot. This is important not only because the player must make rapid changes between forehand and backhand grips but because many players, coaches and teaching professionals prefer the Continental grip for volleying at the net, and some prefer the Continental grip during serving, as well.

It is possible that, if the part of the stop means of this grip guide against which the player's thumb abuts in an Eastern backhand grip extends for a considerable distance to provide a long guide surface for the thumb, there may be some obstruction to the player's hand if the hand is placed on the handle in position for an old-fashioned, or Conventional Western grip. Any such obstruction would be irrelevant, since the grip guide of this invention would not be employed if the old-fashioned Western grip, which is the same for both forehand and backhand, were for some reason used by a player.

If a grip that approaches the conventional Western grip is used for forehand shots and an Eastern backhand grip is used for backhand shots, as some top players do today, any obstruction such as just described can be avoided simply by moving the grip guide somewhat farther away from the free end of the racquet when it is secured in place to indicate the proper grip for an Eastern backhand shot, and then sliding the racquet holding hand slightly toward the end of the racquet when positioning the hand for a forehand shot.

As will be seen from FIG. 7, another feature of the grip guide of this invention that assists in avoiding any obstruction as the position of the player's hand is changed for various shots, is the absence from longitudinally aligned outer surface 75 of shell 70 of any elongated depressions oriented transverse to central longitudinal axis 76 of the shell. Outer surface 75 is free of any such depressions or "recesses" or "grooved imprints," which are essential features of the devices disclosed in certain prior art patents.

To summarize, when a player's hand that is in the position shown in FIG. 5 is place against guide surfaces 88/90 of FIG. 11 (also indicated in FIG. 14), the hand will be automatically guided into the proper position for an Eastern backhand grip. If the player then rotates his or her hand on the racquet handle what seems to the player to be a ⅛ turn, or a little more, in the clockwise direction (as seen from free end 86 of the racquet handle), the hand will be in the proper position for an Eastern forehand shot.

Although in this position of the player's hand grip guide 70 will not perform any guidance function for the hand, at the same time (as will be seen from FIG. 23) it is a distinct advantage that there is nothing on the surface of the handle to block or hinder the described rotation during the repositioning of the hand from the backhand to the forehand position. Moreover, it is an additional advantage with this preferred embodiment of the grip guide of this invention that (as will be seen by a comparison of FIGS. 6 and 24) both in the Eastern backhand position as determined by the grip guide (FIG. 6) and in the Eastern forehand position as selected by the player (FIG. 24), the butt of the palm of the player's racquet holding hand is located at substantially the same distance from free end 86 of the racquet handle.

Again, as can be seen by a comparison of FIGS. 16 through 18 with FIG. 23, when the grip guide is positioned to provide guidance for the correct grip for a Continental shot, there is nothing on the surface of the handle to block or hinder rotation, whenever desired, to reposition the player's hand by clockwise rotation (as seen from the free end of the handle) into what seems to the player to be the proper position for an Eastern forehand shot or, if the player slides his or her hand slightly toward the free end of the racquet handle at the same time that it is rotated counterclockwise (as seen from the end of the handle), into what seems to the player to be the proper position for a one-handed Eastern backhand shot.

Possible Use To Indicate The Proper Position Of the Hand For Eastern Forehand Shots As has been stressed, the principal or preferred use for the device of this invention is to provide an automatic guide for the grip that is to be used for a conventional one-handed Eastern backhand shot. Thus, the preferred position of grip guide 70 on racquet handle 86 is with the bottom 92 of "V"-shaped guide surfaces 88/90 adjacent first beveled planar surface B of the racquet handle, as shown in FIGS. 14 and 15.

As mentioned above, if the player desires, the grip guide of this invention may also be used to provide a guide for a Conventional grip. For this purpose, grip guide 70 is positioned with bottom of "V"-shaped guide surfaces 88/90 adjacent the edge of first beveled planar surface B of racquet handle 30 that borders to planar surface C of the handle.

If desired, the grip guide of this invention has still another use in addition to indicating the proper position for an Eastern backhand or Continental grip. This, if a player or coach wishes for some reason—for instance, to familiarize a beginning player with how to make a forehand shot before moving on to the backhand or other shots—to place the grip guide on the racquet handle in a position to guide the player's racquet holding hand to a conventional Eastern forehand grip, this may be done.

It will be recognized by reference to FIGS. 22 through 24 that in any such case grip guide 70 can be located to indicate the proper position for an Eastern forehand grip by rotating the grip guide upon the handle in the clockwise direction (as seen from free end 86 of the handle) a suitable angular distance, such as, for example approximately 45°, from the position it occupies in those three Figures. As seen from FIGS. 23 and 24, rotating grip guide 70 in the clockwise direction for an angular distance of about 45° will bring bottom 92 of rounded "V" guide surface 88/90 above top planar surface C of the racquet handle 30, where it will provide a guide for gap 50 between base knuckle 42 of thumb 44 and base knuckle 46 of the index finger of the player's hand.

Finally, as will be perceived (again by reference to FIGS. 22 through 24), the grip guide of this invention may, if one chooses to do so, be rotated clockwise from the conventional Eastern backhand position through an angular distance of more than 45°, into one of the several positions that are sometimes employed for a forehand shot with extra topspin. In these latter positions, bottom 92 of rounded "V" 88/90 will typically be brought to where it lies adjacent right-hand edge 60 of top planar surface C, or adjacent second beveled planar surface D, of racquet handle 30. In this location, gap 50 between knuckles 42 and 46 will be guided to a position somewhat above that illustrated in FIG. 23.

When the grip guide is secured to the racquet handle in any of the rotated positions just described in the preceding three paragraphs, if the player then wishes to change to a one-handed Eastern backhand grip, this may be done without encountering any obstruction if at the same time, in order to avoid striking the grip guide, the player's hand is slid down somewhat closer to free end 86 of the racquet handle than it is in the rotated position for an Eastern forehand grip referred to. To keep from bringing the player's palm too far down on the racquet handle when the hand is thus slid into a position for an Eastern backhand shot from any of the rotated positions described just above (which provide an automatic guide for either a conventional or an extreme topspin Eastern forehand grip), the grip guide may be positioned somewhat higher on handle 30—i.e., to the left in FIGS. 22 through 24—when it is initially secured to the racquet handle to provide guidance for an Eastern forehand of one type or another.

Possible Use For Two-Handed Backhand Shots

The terms "forehand" and "Eastern backhand" are used in this specification and claims to refer to shots made with one-handed grips. The grip guide of this invention is primarily designed for use with such shots. However, it may when properly designed by used to guide a player's dominant hand—as for example, a right-handed player's right hand—into the proper position for a two-handed backhand shot if the two-handed grip employed by that player involves (as it does with some players) moving the dominant hand into a position different from the position it occupies in forehand shots.

To make the device of this invention useful in two-handed backhand shots, the stop means of the grip guide should be formed of a suitable material that is (1) strong enough to provide a reliable guide surface for positioning the dominant hand on the racquet handle, and (2) at the same time, thin enough that the stop means does not force the other hand to be separated too far from the dominant hand when the two hands are in position for the two-handed shot. Likewise, the base portion of the grip guide, which when secured to the racquet handle supports the stop means that provides the guide surface for the dominant hand, must be (1) strong enough to provide a secure attachment to the racquet handle, and (2) thin enough that it interposes no significant obstruction underneath the other hand when that hand is placed on the racquet handle next to the player's dominant hand to provide a two-handed grip.

Details of Manufacture

As will be understood, the grip guide of this invention may be fabricated of any suitable material such as moldable plastic material. While such material can be selected to be firm enough to provide the necessary guide surfaces as described above, if properly selected it will be of such light weight that it will not interfere with the player's strokes, whether used in practice or in actual competition.

If desired, the grip guide can be attached permanently to the racquet handle. In such case, instead of a securing band such as has been described above, a suitable permanent adhesive may be used.

The above detailed description has been given for clarity of understanding only. No unnecessary limitations should be understood therefrom, as modifications will be obvious to persons skilled in the art.

We claim:

1. A grip guide for positioning on a tennis racquet handle which comprises:

(a) an elongated shell having a longitudinally aligned concave undersurface and a longitudinally aligned outer surface, said shell including a central longitudinal axis, a first side portion, and a second side portion, said first and second side portions lying on opposite sides of said longitudinal axis, said side portions extending laterally outward from said central axis, one on each side of the axis to form said concave undersurface, said elongated shell having a forward end and a back end; and (b) means for securing said elongated to said racquet handle, said elongated shell terminating at its said forward end in a guide surface in the approximate shape of a rounded "V" having two arms, said two arms slanting away from said forward end of the elongated shell in opposite lateral directions on either side of said longitudinal axis, with the bottom of said rounded "V" being configured to extend in the opposite direction from said back end of the elongated shell, said guide surface in the approximate shape of a rounded "V" at the forward end of the elongated shell being free of any projection extending in the forward direction away from said guide surface, and said longitudinally aligned outer surface of the elongated shell being free of any elongated depressions oriented transverse to said central longitudinal axis of the shell, whereby when said grip guide is positioned securely on said racquet handle in a predetermined location, it indicates to the player using the racquet the proper position of the hand on the racquet handle in order to make a given type of shot most effectively, and substantially the entire surface of said racquet handle between said guide surface at the forward end of said elongated shell and the free end of the racquet handle is free of any obstruction to rotation of the player's hand from one position on the handle to another.

2. The grip guide of claim 1 in which the forward end of said elongated shell is configured to provide a guide surface for the portion of the player's hand that defines the gap between the base knuckles of the player's finger and thumb.

3. The grip guide of claim 27 in which the arm of said rounded "V"-shaped guide surface that slants away from said forward end of said elongated shell in the direction of the index finger of the hand in which the racquet is held in a one-handed grip during play is longer than the other arm of said guide surface.

4. The grip guide of claim 3 in which said longer arm of said rounded "V"-shaped guide surface at the forward end of said elongated shell slants away from said forward end of the shell more sharply than said other, shorter arm of said guide surface.

5. The grip guide of claim 4 in which said longer arm of said rounded "V"-shaped guide surface at the forward end of said elongated shell is oriented at an angle of about 30° to about 75° to said central longitudinal axis of the elongated shell.

6. The grip guide of claim 4 in which said longer arm of said rounded "V"-shaped guide surface at the forward end of said elongated shell is oriented at an angle of approximately 45° to the central longitudinal axis of the elongated shell.

7. The grip guide of claim 4 in which said other, shorter arm of said rounded "V"-shaped guide surface at the forward end of said elongated shell is oriented at an angle of at least about 30° and less than 90° to said central longitudinal axis of the elongated shell.

8. The grip guide of claim 4 in which said other, shorter arm of said rounded "V"-shaped guide surface at the forward end of said elongated shell is oriented at an angle of approximately 80° to said central longitudinal axis of the elongated shell.

9. The grip guide of claim 4 in which the portion of said other, shorter arm of said rounded "V"-shaped guide surface that is immediately adjacent said central longitudinal axis slants away from said forward end of the elongated shell more sharply than the portion of said other arm that is located farther from said central axis of the grip guide than said immediately adjacent portion, whereby a guide surface is provided for said base knuckle of the thumb on the player's racquet holding hand when said grip guide is secured to the racquet handle as aforesaid.

10. The gripp guide of claim 1 in which said elongated shell is configured such that the portions of the shell that are spaced farthest from said concave undersurface of the shell, measured perpendicularly to said undersurface, extend in the forward direction from said shell farther than the inner portions of said elongated shell that are located adjacent said concave undersurface.

* * * * *